United States Patent [19]

Wilburn et al.

[11] Patent Number: 4,781,252

[45] Date of Patent: Nov. 1, 1988

[54] STORAGE TANK FIRE EXTINGUISHING APPARATUS

[75] Inventors: Thomas G. Wilburn, Orange, Tex.; William C. Gray, Lake Charles; William E. Myers, DeRidder, both of La; Richard P. Bauer, Annandale, Va.

[73] Assignee: Citgo Petroleum Corp., Tulsa, Okla.

[21] Appl. No.: 142,248

[22] Filed: Jan. 7, 1988

Related U.S. Application Data

[63] Continuation of Ser. No. 073,838, Jul. 15, 1987, abandoned, which is a continuation of Ser. No. 862,796, May 13, 1986, abandoned.

[51] Int. Cl.[4] ..... A62C 35/54

[52] U.S. Cl. ..... 169/68; 169/66; 169/52; 169/60; 118/306; 134/167 R; 134/168 R; 134/181

[58] Field of Search ..... 169/26, 51, 52, 60, 169/61, 66, 67, 68, 70; 239/750, 751; 118/305, 306, 108, 207; 734/167 R, 168 R, 180, 181; 137/899.1

[56] References Cited

U.S. PATENT DOCUMENTS

| | | | |
|---|---|---|---|
| 2,079,438 | 5/1937 | Ellis | 169/66 |
| 2,415,500 | 2/1947 | Kennison | 118/305 X |
| 3,588,893 | 6/1971 | McCloskey | 169/61 |
| 4,285,469 | 8/1981 | Hammelmann | 239/750 |
| 4,349,039 | 9/1982 | Egger | 239/578 X |

FOREIGN PATENT DOCUMENTS

| | | | |
|---|---|---|---|
| 2069374 | 8/1981 | United Kingdom | 118/305 |

*Primary Examiner*—Galen Barefoot
*Assistant Examiner*—Paul E. Salmon
*Attorney, Agent, or Firm*—Cushman, Darby & Cushman

[57] ABSTRACT

Apparatus for fighting fires within storage tanks includes a frame movably coupled to the lip of the storage tank. The frame includes rotatable members by which the frame may be moved around the lip of the storage tank. Attached to the frame is a holding device adapted to hold a fire extinguisher nozzle on the interior of the storage tank so as to direct fire extinguishing agents down the inside face of the storage tank. The apparatus may include a fire detector to detect the presence and location of the fire, propulsion means to automatically move the apparatus around the storage tank to a location adjacent to the fire source, and a storage tank for storing fire suppressing agents be used to extinguish the fire.

16 Claims, 3 Drawing Sheets

STORAGE TANK FIRE EXTINGUISHING APPARATUS

This is a continuation of application Ser. No. 73,838, filed July 15, 1987, which was abandoned upon the filing hereof, which is a continuation of application Ser. No. 862,796, filed May 13, 1986, now abandoned.

BACKGROUND OF THE INVENTION

This invention relates to apparatus for extinguishing a fire in a storage tank. More particularly, this invention relates to a fire extinguishing mechanism movably coupled to the lip of an oil storage tank so that the apparatus can move around the storage tank lip to an appropriate location to direct fire suppressant material on the fire.

With the increasing use of petrochemical substances in our society, petrochemical storage tanks are being located in a wide variety of work locations, such as tank "farms", factories, process plants, refineries, etc. Fire hazards associated with such storage tanks are well known and must be adequately addressed before the tanks can be properly positioned in any work environment. In large storage tank farms, the fire hazard is exacerbated by the great number of tanks requiring fire detection/suppression, and the possibility of fire being transmitted from one tank to the next. Therefore, it is essential that apparatus be provided which is capable of quickly and efficiently suppressing a fire ignited on the inside of a petrochemical storage tank.

The typical petrochemical storage tank is cylindrical in shape and has a roof which floats on the petrochemical stored within the tank. The floating roof includes flexible seals at its periphery to movably seal the floating roof to the inside of the storage tank. It is at this periphery that the greatest danger of fire exists. Fires in such floating roof tanks is usually ignited and sustained at the gap between the floating roof periphery and the interior wall of the tank. It is therefore essential to quickly and efficiently place fire suppressant materials around the interior surface of the petrochemical storage tank.

Many fire suppression systems are known which actively suppress a fire in a floating roof oil storage tank. U.S. Pat. No. 3,896,881 to De Boer discloses an automatic fire extinguisher having a fluid distribution pipe network extending around the periphery of the floating roof. This pipe network carries fire extinguisher materials around the periphery of the floating roof. A plurality of fire extinguisher storage tanks are coupled to the pipe distribution network at various locations around the floating roof. The pipe distribution network includes a plurality of sprinklers which direct the fire suppressant material to the gap between the floating roof and the inside wall of the storage tank. Each sprinkler is designed to open at a given temperature so that the system automatically detects and responds to a fire inside the storage tank. De Boer even proposes a second pipe distribution network having sprinklers which operate at a different temperature than the sprinklers of the first network. Thus, fires of different intensities may be fought with this apparatus.

However, the distributed sprinkler apparatus according to De Boer is incapable of providing a large quantity of fire suppressant material directly onto a fire. Each sprinkler of De Boer is only capable of providing a fixed amount of fire suppressant material at a given location.

If the fire is very intense at a specific location, it is possible that insufficient fire suppressant material will be provided to extinguish the blaze. In addition, the apparatus according to De Boer is adapted to be permanently fixed to the floating roof inside the storage tank. This greatly adds to the time and expense necessary to manufacture these floating roofs. Existing storage tank roofs would have to be extensively modified to practice the invention according to the apparatus of De Boer. Finally, the De Boer apparatus cannot be moved from tank to tank in response to fire conditions. Thus, the cost of each storage tank is greatly increased and the majority of the De Boer apparatuses will never be used since the majority of oil storage tanks never catch fire.

U.S. Pat. No. 1,955,265 to Warnock solves some of the above-discussed problems by providing a foam applicator capable of being moved from tank to tank in response to a given fire condition. As depicted in FIG. 1, the apparatus according to Warnock provides apparatus used to hoist the foam nozzle over the lip of the oil storage tank. Hook 3 is coupled to the lip of the storage tank while block and tackle 22, 23, and 24 are manipulated to hoist foam nozzle 21 over the lip of the tank. However, as can be appreciated from FIG. 5, once the foam nozzle has been positioned it is very difficult to move the foam nozzle around the lip of the tank. Thus, where the fire has been suppressed at one portion of the storage tank, the Warnock apparatus requires a difficult and time consuming effort to move the nozzle to another location on the tank. While the nozzle is being moved, it is entirely probably that the fire will be reignited in the already-extinguished portions of the tank.

Therefore, it is apparent that what is needed is a storage tank fire-suppression apparatus which is capable of being inexpensively manufactured, easily transported to the storage tank, and coupled to the storage tank in such a way as to enable the fire suppressant material to be quickly applied directly at the location of the fire. Such an apparatus should be movable around the tank so that fire extinguishing materials may be quickly and accurately directed to the fire source.

SUMMARY OF THE INVENTION

In order to overcome the above-discussed disadvantages of known storage tank fire extinguishing devices, the present invention provides an apparatus which is movably coupled to the lip of the storage tank and holds a fire extinguisher nozzle directed toward the interior surface of the tank. The apparatus is movable around the lip of the storage tank so that the fire extinguisher may be accurately directed to the fire source.

Preferably, the apparatus includes a fire detector which detects the presence and location of a fire source within the tank. The apparatus may also include propulsion means for driving the apparatus around the lip of the storage tank. Control circuitry may be provided to drive the propulsion means to a location at which the fire detector senses the presence of a fire source. Thus, the apparatus can remotely and automatically place fire extinguishing foam directly on the fire source.

The apparatus according to the present invention may also include a fire extinguisher storage tank capable of holding sufficient fire extinguishing material to suppress a storage tank fire. Thus, the present invention may be provided as an independent, remotely activated, automatic fire extinguishing system capable of detecting and extinguishing a fire without the invention of human fire fighters. Such a system would be coupled to the storage tank and would automatically detect and suppress a fire breaking out on the interior of the tank.

BRIEF DESCRIPTION OF THE DRAWINGS

These and other advantages of the present invention may be appreciated from studying the following detailed description of the presently preferred exemplary embodiment together with the drawings in which.

DETAILED DESCRIPTION OF THE PRESENTLY PREFERRED EXEMPLARY EMBODIMENT

Figure 1:
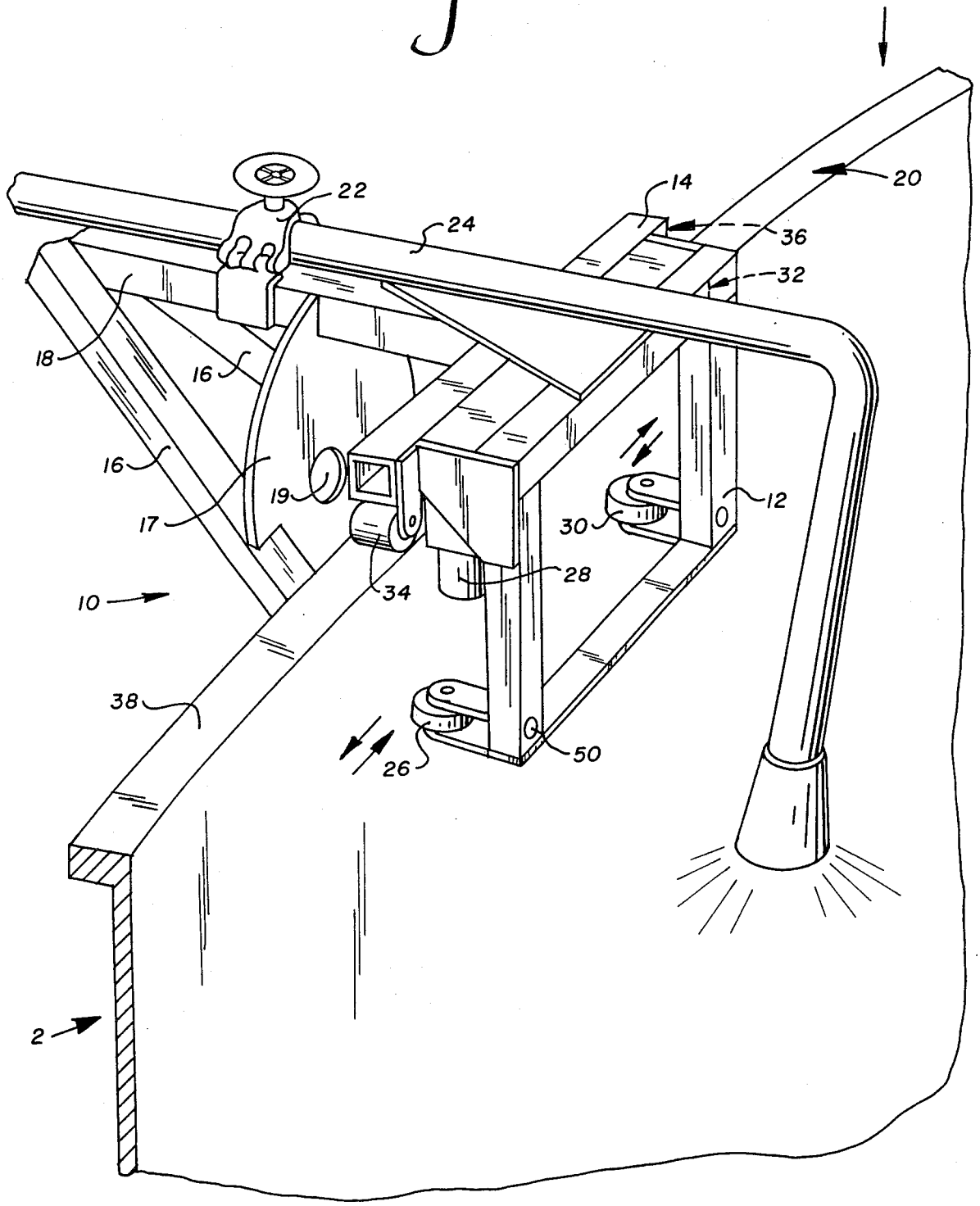
FIG. 1 is a perspective view of a first embodiment according to the present invention.

Referring to FIG. 1, the apparatus according to the present invention provides a frame 10 which is movably coupled to the lip 20 of cylindrical oil storage tank 2. Those having ordinary skill in this field will understand that storage tanks may come in a wide variety of sizes and shapes, to include cylindrical, curvelinear, octagonal, etc. It is to be understood that this invention is directed toward a fire extinguishing apparatus which may be used with any shape of storage tank.

Frame 10 includes interior frame number 12 adapted to be movably coupled to the interior of storage tank 2. Frame 10 also includes top frame member 14 adapted to be movably coupled to the top of lip 20. Finally, frame 10 includes exterior frame members such as struts 16, plate 17, and top bar 18. Coupled to top bar 18 is a extinguisher nozzle clamp 22 which is adapted to hold a fire extinguisher nozzle 24. As depicted in FIG. 1, fire nozzle 24 is positioned to direct fire suppressant materials to the interior face of storage tank 2. Thus, the fire suppressant material is directed at the flexible seal between the periphery of the floating roof and the interior surface of the cylindrical tank.

Interior frame 12 includes four rollers. Rollers 26 and 28 are provided on one side of interior frame 12, while rollers 30 and 32 (not shown) are provided at the other side. These rollers are freely rotatable and provide support for the apparatus as it moves around lip 20 of the storage tank 2. Top frame 14 includes rollers 34 and 36 (not shown) which act to support the weight of the apparatus on the top of lip 20.

Each of struts 16 includes a roller 38 (see FIG. 2) coupled at one end of the strut. This roller is adapted to contact the exterior surface of storage tank 2 and to be rotatable therearound.

In operation, the apparatus is placed over lip 20 of storage tank 2 and then moved therealong until the fire extinguisher nozzle 24 is appropriately positioned to fight the fire inside the tank. Thus, to move the fire extinguisher nozzle 24 from one location to another merely requires the apparatus to be pushed or pulled in the proper direction. For this purpose, plate 17 may have a hole 19 therein through which a rope may be tied so that a person on the ground may pull the apparatus to the appropriate location. Once the apparatus is properly positioned, fire extinguishing foam may be provided to the fire extinguishing nozzle 24 from a convenient location outside the tank. The fire suppressant material may be provided to nozzle 24 by means of a flexible hose or other acceptable transmission line (not shown).

As a modification to the basic structure, the apparatus according to the present invention may include a fire sensor 50 coupled to interior frame 12. Fire sensor 50 is capable of detecting the presence and/or the location of a fire in the interior of storage tank 2. Fire sensor 50 may be conveniently mounted to interior frame 12, fire extinguishes nozzle 24, top frame 14, or any location convenient and practical to a given fire hazard situation. Fire detector 50 may be a single detector or a plurality of fire detectors using such technology as infra-red heat detection, optical detection, smoke detection, etc. A combination of such sensors, located together or separates by a given distance, may be used to more accurately determine the location of a fire source. Those having skill in this field will readily appreciate the wide variety of fire sensors which may be used within this system.

The apparatus according to the present invention may also include control system 52 (see FIG. 2), shown coupled to plate 17. Control system 52 includes electronic circuitry which is coupled (via wire 51) to receive fire detection signals from fire detector 50. Control system 52 provides useable electrical signals which may be used to properly locate fire suppression nozzle 24 over the fire source. These usable electrical signals may include, but are not limited to, visual and/or audible direction signals which indicate to a fire fighter on the ground outside of the tank in which direction to push/pull the apparatus; visual and/or audible fire intensity signals used to alert the fire fighter as to the quantity or type of fire suppression material required; propulsion signals used to command a propulsion device (to be described later) to automatically drive the apparatus around the lip of the storage tank; and valve actuating signals to open a valve (not shown) in fire extinguisher nozzle 24 to automatically begin providing fire extinguishing material to the interior of the tank. Persons of ordinary skill in the field will quickly understand the types of usable electrical signals which may be provided by control system 52 and the variety of uses to which these signals may be applied.

Figure 2:
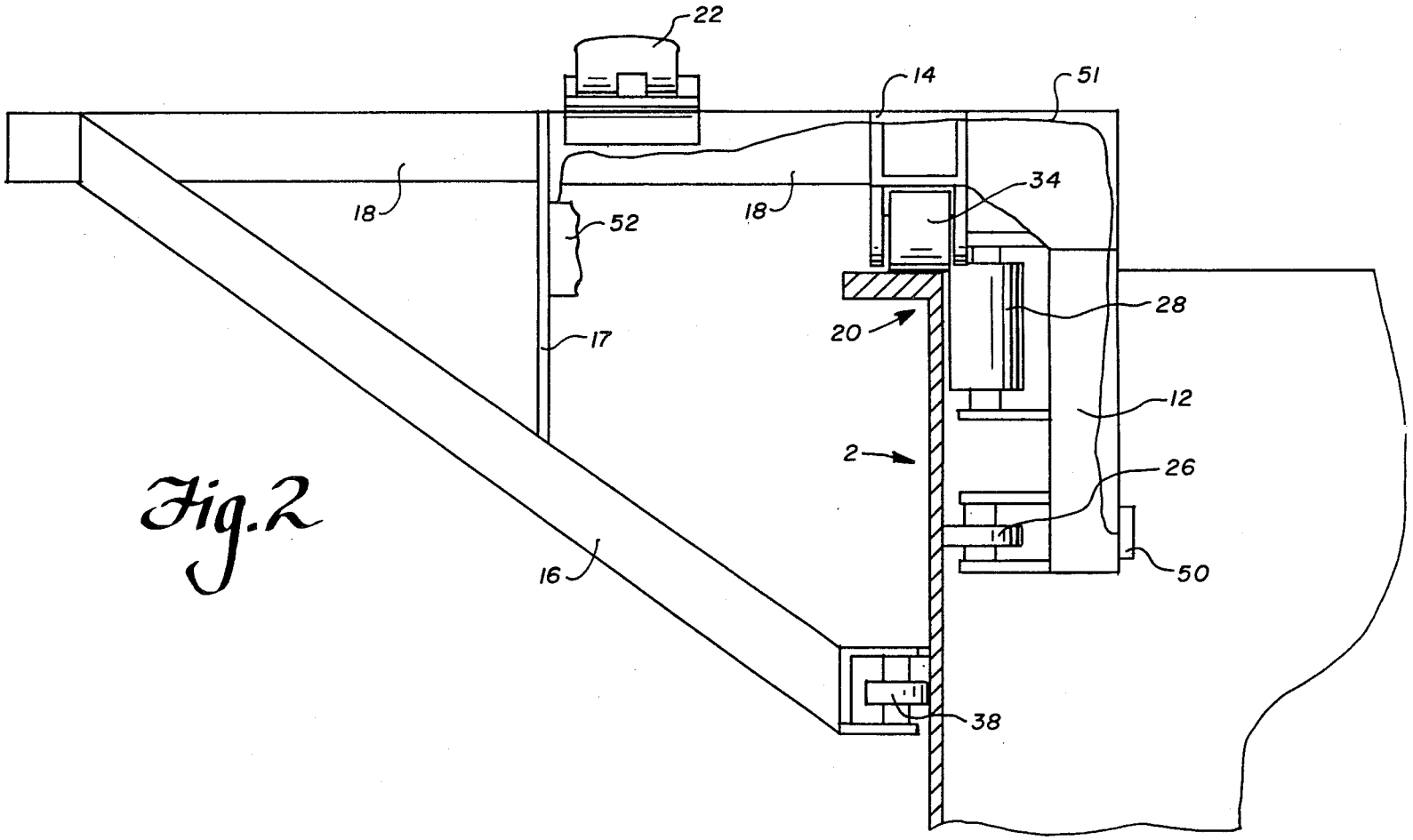
FIG. 2 is a side-view of the embodiment depicted in FIG. 1.

FIG. 2 is a side elevation drawing of the apparatus according to FIG. 1. FIG. 2 depicts interior rollers 26 and 28 coupled to interior frame member 12. Top roller 34 is coupled to top frame member 14 and rests upon the top of lip 20.

FIG. 2 clearly shows that top bar 18 and struts 16 are used to counter-balance the weight of the apparatus against the outside of tank 2. Thus, a roller 38 is provided at the end of each strut 16 and abuts the exterior wall of tank 2. With this configuration of rollers on the inside, top, and outside of the storage tank, a stable and steady structure may be provided. Thus, the force generated by the fire extinguishing material rushing through the nozzle and the weight of the device itself will be properly counter balanced.

While the presently preferred embodiment includes rollers for movably contacting the storage tank 2, persons of ordinary skill in this field will recognize that any types of movable members may be provided. For example, ball bearings, caterpiller tractors, slip bearings, or other members may be used to provide movable coupling between the apparatus and storage tank 2.

As used in the specification and claims, the word "coupling" is used to define a physical interrelationship between two elements. This relationship may be either a direct contact or an indirect contact. For example, the apparatus is directly coupled to the storage tank while the nozzle holding device 22 is indirectly coupled to the storage tank (via top bar 18 and top frame member 14, etc.). Nevertheless, both elements are "coupled to" the storage tank.

Figure 3:
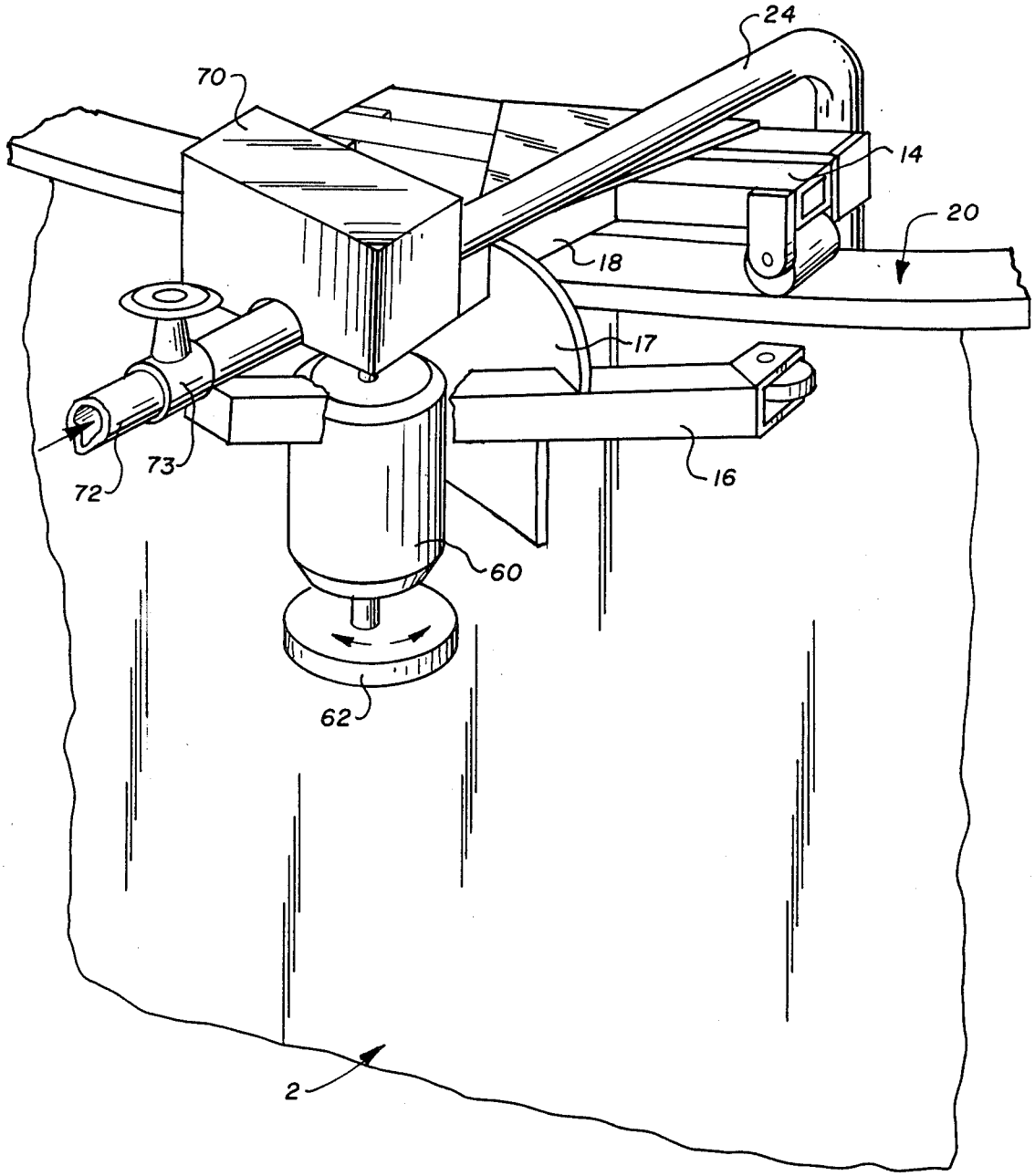
FIG. 3 is a perspective view of a second embodiment according to the present invention.

FIG. 3 is a perspective view of a second embodiment according to the present invention. In this embodiment, propulsion device 60 is mounted to the apparatus outside the storage tank. Propulsion device 60 is coupled to struts 16 and top bar 18. Propulsion device 60 may be, for example, a battery-powered DC motor capable of forward and reverse rotation.

Coupled to motor 60 is drive wheel 62 which frictionally engages the exterior of storage tank 2 to propell the apparatus around lip 20 of storage tank 2. Drive wheel 62 may be driven in either the clockwise or counter clockwise direction in order to drive the apparatus to a given location on the tank lip. The propulsion device 60 may be controlled through a remote control device positioned outside the tank near the ground (not shown). Thus, a firefighter on the ground outside the tank can "drive" the apparatus to a specific location on the tank lip.

Preferably, propulsion device 60 is coupled to control means 52 and is responsive to the fire detection signals provided from fire detector 50. Thus, when a fire is detected at a given location on the interior of storage tank 2, control device 52 will command propulsion device 60 to drive the apparatus around the storage tank to a location substantially adjacent the detected fire source. In such a fashion, the apparatus according the present invention can automatically provide fire suppressant material directly on the fire source. Thus, a fire fighter is not required to guess the location of the fire source or to attempt to view the interior of the burning tank.

An additional modification which may be provided in the apparatus according to FIG. 3 is a storage tank 70 for storing fire suppressant materials. Such materials include, but are not limited to, foam, chemicals, powders, fluids, etc. As used in the specification and claims, the term "fluid" is intended to encompass all such fire suppressant material which may be applied through nozzle 24. Such materials may be, for example, aerosols, binary chemicals, foam generating chemicals, powders, liquids, etc.

Fire suppressant storage tank 70 is coupled to nozzle 24 so that fire suppressant material stored inside of tank 70 may be provided directly to the fire source through the nozzle 24.

Preferably, either the nozzle 24 or the storage tank 70 includes a valve and valve actuator (not shown) which is controlled by control device 52. Control device 52 may command the valve to open and close in accordance with the fire detection signal received from fire detector 50. Thus, the apparatus provides fire suppressant material only so long as a fire source is active inside tank 2.

In a further modification of the apparatus according to FIG. 3, an auxiliary pipe 72 and valve 73 may be provided coupled to storage tank 70. Thus, storage tank 70 may be refilled through the auxiliary pipe 72 and valve 73. Alternatively, should the fire suppressant material in storage tank 70 be exhausted, additional fire suppressant material may be provided to nozzle 24 through auxiliary pipe 72. Thus, additional fire suppressant material may be provided while the fire is being fought.

The apparatus according to FIG. 3 is thus capable of remotely and automatically detecting and extinguishing a fire inside of a storage tank. Such an apparatus would eliminate the need for continually monitoring oil storage tanks to detect fire therein. The apparatus according to FIG. 3 may be placed on an oil storage tank and left in place. Should a fire occur inside the tank, it will be detected by fire sensor 50, which passes a signal to control unit 52. Control unit 52 then commands propulsion device 60 to drive the apparatus to a location on the tank lip substantially adjacent the detected fire source. Control unit 52 then commands the valve inside nozzle 24 or storage tank 70 to open thus applying fire suppressant material directly on the source of the fire. Control unit 52 will continually move the device to active fire sources and dispense fire suppressant materials on those sources until no more fire is detected within the interior of the tank. Thus, a storage tank fire may be detected and extinguished before a human is even aware of the problem.

In accordance with the present invention, the preferred fire nozzle is a JS/10 Aer-o-foam made by the National Foam Company. Alternatively, a turbo-jet fog nozzle may be used when using an A.T.C.-type AFFF concentrate. With such nozzles, the operating pressure of the fluid handling system is approximately 100–150 pounds per square inch.

According to the present invention, the apparatus without the propulsion device 60 or storage tank 70 is designed to weigh less than 75 pounds. This light-weight construction allows the apparatus to be quickly moved to a particular storage tank and easily hoisted and coupled to the lip of the tank. This light-weight structure thus adds to the flexibility and variety of uses to which this device may be put.

While the invention has been described in connection with what is presently considered to be the most practical and preferred embodiments, it is to be understood that the invention is not limited to the disclosed embodiment but, on the contrary is intended to cover various modification and equivalent arrangements included within the spirit and scope of the appended claims. For example, a separate rail may be fixed to the lip of the storage tank, and the apparatus according to the present invention may be physical coupled to the rail. However, in such a structure the apparatus is still movably coupled (indirectly) to the tank lip. Therefore, persons of ordinary skill in this field are to understand that all such equivalent structures are to be included within the scope of the following claims.

We claim:

1. An apparatus for mounting a fire a suppressant delivering nozzle to a circumferential lip of a tank comprising:

a mainframe member;

means for mounting said mainframe member to the circumferential lip so that said mainframe member is movable on said lip about a least a portion of the circumference of the tank, said means for mounting including a first roller adapted to engage and roll along an interior of the lip of the tank, a second roller adapted to engage and roll along the top of said lip and a third roller adapted to engage and roll along an exterior of the lip; and means for fixedly coupling a fire suppressant delivery nozzle to a portion of said mainframe member disposed vertically above the circumferential lip.

2. Apparatus according to claim 1 further including fire-suppressant nozzle means, coupled to said coupling means, adapted for directing fire-suppressant material to an interior of said tank.

3. Apparatus according to claim 2 further including a fire-suppressant storage tank, coupled to the mounting means, for storing said fire-suppressant material and providing it to said nozzle.

4. Apparatus according to claim 2 further including fire detection means, coupled to said mounting means, for detecting a fire inside said tank and for activating said nozzle to cause fire-suppressant material to be exited from said nozzle.

5. Apparatus according to claim 4 further including propulsion means, coupled to said mounting means, for driving said apparatus along said lip.

6. Apparatus according to claim 5 further including control means, coupled to said fire detection means, and said propulsion means, for causing said propulsion means to move said apparatus to a location on said tank lip which is substantially adjacent a fire detected by said fire detection means.

7. An apparatus for mounting a fire suppressant delivering nozzle to the circumferential lip of a storage tank comprising:

a holding device including means for fixedly holding a fire extinguishing nozzle and means for coupling said holding device to said lip so as to be circumferentially movable about said lip, said means for holding being disposed so as to be vertically above the lip when said holding device is coupled to said lip;

said holding device including a first plurality of rotatable members adapted to contqact an interior of the tank, a second plurality of rotatable members for contacting a top of said tank lip and a third plurality of rotatable members for contacting an exterior of said tank.

8. Apparatus according to claim 7 wherein said holding device includes counterbalance means, coupled to said third plurality of rotatable members, for stabilizing said holding device on said tank.

9. Apparatus according to claim 7 wherein each of said first, second, and third pluralities of rotatable members includes first and second rotatable devices spaced apart along a direction substantially tangetial to the cylindrical tank lip.

10. Apparatus according to claim 9 wherein all of said rotatable devices comprise rollers.

11. Apparatus according to claim 10 wherein the rollers of said first and third plurality of rotatable members rotate about a substantially vertical axis, and wherein the rollers of said second plurality of rotatable members rotate about a substantially horizontal axis.

12. Apparatus for mounting a fluid nozzle to a circumferential lip of a tank comprising:

means for fixedly holding a fluid nozzle so as to provide fluid to the interior of said tank;

means for coupling said holding means to the lip of said tank so as to be movable along and about said lip, said coupling means including a first frame member having a first rotatable member in contact with the interior of said tank, a second frame member having a second rotatable member in contact with a top of said tank and a third frame member having a third rotatable member in contact with an exterior of said tank, said means for holding being mounted to said second frame member so as to be disposed vertically above said lip.

13. Apparatus according to claim 12 wherein said holding means includes a clamp.

14. Apparatus according to claim 12 further including propulsion means, coupled to said coupling means, for propelling said apparatus along said lip.

15. Apparatus according to claim 14 further including fire detection means, coupled to said coupling means, for detecting the presence and location of fire within said tank.

16. Apparatus according to claim 15 further including control means, coupled to said fire detection means and to said control means, for causing said propulsion means to propel said apparatus to a location on said lip substantially adjacent the detected location of said fire.

* * * * *